United States Patent [19]

van Hesden

[11] B 4,003,839

[45] Jan. 18, 1977

[54] NON-FOAMING LUBRICATION OIL

[75] Inventor: Jan Willem van Hesden, Baulkham Hills, Australia

[73] Assignee: Borg-Warner Corporation, Chicago, Ill.

[22] Filed: May 9, 1974

[21] Appl. No.: 468,603

[44] Published under the second Trial Voluntary Protest Program on March 23, 1976 as document No. B 468,603.

[30] Foreign Application Priority Data

May 31, 1973 Australia ..... 3505/73

[52] U.S. Cl. ..... 252/25; 252/33; 252/39; 252/41; 252/49.7; 252/358

[51] Int. Cl.[2] ..... C10M 1/10

[58] Field of Search ..... 252/25, 33, 33.6, 34, 252/39, 41, 46.4, 49.7, 358

[56] References Cited

UNITED STATES PATENTS

| | | | |
|---|---|---|---|
| 2,411,671 | 11/1946 | Smith et al. | 252/34 X |
| 2,533,878 | 12/1950 | Clark et al. | 252/33 X |
| 2,991,248 | 7/1961 | Preston et al. | 252/358 X |
| 3,086,944 | 4/1963 | Wedell | 252/358 X |
| 3,111,381 | 11/1963 | Panzer et al. | 252/25 X |
| 3,402,188 | 9/1968 | Wiese | 252/358 X |
| 3,464,923 | 9/1969 | Roche et al. | 252/25 X |
| 3,471,403 | 10/1969 | Lesuer et al. | 252/39 |

FOREIGN PATENTS OR APPLICATIONS

| | | | |
|---|---|---|---|
| 209,175 | 11/1956 | Australia | 252/33 |

OTHER PUBLICATIONS

Ross, "Chemical Antifoaming Agents", May 1949, Chemical Industries, pp. 757–759.

Kalichevsky et al., "Petroleum Refining with Chemicals", 1956, pp. 649–651.

*Primary Examiner*—Delbert E. Gantz
*Assistant Examiner*—Andrew H. Metz
*Attorney, Agent, or Firm*—Richard J. Schlott

[57] ABSTRACT

A lubrication oil having improved resistance to foaming and a method for preventing foaming of lubrication oils comprising the adding of dehydrating agents to the lubrication oil.

4 Claims, No Drawings

NON-FOAMING LUBRICATION OIL

BACKGROUND OF THE INVENTION

This invention relates to prevention of foaming in lubrication oil.

Lubrication oil in automotive differentials and gear boxes of industrial machines frequently foams after prolonged use. When the lubrication oil foams, its volume greatly increases and thus part of the oil is forced out of the gear housing through breather holes and the like. Beside causing a loss of oil, foaming also interrupts the proper lubricating function of the oil and so results in rapid wear in the various components of the gear train.

It has been found that foaming occurs when water has been present for sometime in the lubrication oil in a gear box. Water itself does not cause this foaming as no foaming is observed when lubrication oil is agitated in the presence of water deliberately added to the oil. Experiments indicate that water in lubrication oil reacts with the steel surface of the gear trains and of other components in a gear box to form ferric-hydroxide. The rate at which such a reaction takes place depends on temperature, and it may take a considerable period of time before ferric hydroxide is found in any appreciable amount. The ferric hydroxide formed, being basic, will react with various acidic additives commonly present in lubrication oils. Among such additives, sulphur type and, in particular, phosphorous type additives have been found to react with ferric hydroxide to form a reaction product, in the presence of which the lubrication oil will foam after a certain amount of agitation. The exact nature of this reaction product is not known, and such reaction product will be generally referred to hereinafter as metallic salts. The amount of water normally present in lubrication oils may vary considerably. Experiments leading to this invention showed that 0.05% of water is sufficient to lead to subsequent foaming.

The object of this invention is to prevent foaming in lubrication oils.

DESCRIPTION OF THE INVENTION

Broadly, the foaming tendencies of lubrication oil, and in particular, gear box lubricants, can be altered and the foaming prevented by the addition of certain substances to the oil. More particularly, the addition to lubrication oils of certain compounds, which broadly are characterized as dehydrating agents capable of reacting with water, prevents the formation of foam-producing metallic salts during use. Still more particularly, certain dehydrating agents when added to lubricating oils in relatively small amounts prevent foaming in use even under severe conditions.

Accordingly, the instant invention is described as a lubrication oil having improved resistance to foaming and a method for preventing foaming of lubricating oils comprising the addition of dehydrating agents to lubrication oil.

As discussed above, the foaming of lubrication oils would appear to be caused by reaction of water and/or acidic components of lubricating oils with the metallic surfaces within gear trains and cases to form over a period of time ferric hydroxide and subsequently iron salts of unknown composition which in turn promote foaming. While the inventor does not wish to be bound by a particular theory of operation of the instant invention, it appears that the addition of certain dehydrating additives to the lubrication oil effectively prevents the formation of these foam-producing iron or other metallic salts, either by reacting with water present in the lubrication oil or by binding the metallic salts in a form not capable of promoting foaming.

The particular additives which have been found suitable for the purposes of this invention are generally characterized as dehydrating agents. Common dehydrating agents such as anhydrous potassium or sodium sulphate, anhydrous calcium chloride, calcium oxide and the like are particularly useful. Being ionic in character, such inorganic salts do not dissolve in lubrication oil, but they can serve the purpose of this invention if their particle size is small enough that they be kept dispersed in the lubrication oil. The dehydrating agent may also be an oil-soluble organic compound, or a mixture of such compounds, including hygroscopic derivatives obtained by reacting alkaline and alkaline earth methal oxides or their salts with fatty acids, saturated or unsaturated dicarboxylic acids, aminocarboxylic acids, sulphonic, sulphinic or sulphamic acids.

Examples of such compounds include the reaction products of calcium oxide with such fatty acids as oleic acid, sebacic acid, linoleic acid and the like. These may be prepared in situ in the lubricating oil by addition of the metal oxide and the fatty acid to the oil, or the corresponding compound. eg. calcium oleate, may be prepared separately and subsequently added to the lubrication oil.

It will be appreciated that any dehydrating agent that will function as such when dispersed or dissolved in a lubrication oil, and which will not affect adversely the lubricating property of the latter, thereupon may be employed.

The amount of additive to be employed will vary with the particular additive selected, the lubrication oil and the particular end use envisioned. Certain of these are effective foam prevention additives at concentrations as low as 0.1% by weight, while with others an amount as great as 5% by weight may be required for long term effectiveness under conditions of severe use and exposure to moisture.

The practice of the present invention is further illustrated by means of the following examples, wherein the foam-preventing effectiveness of several additives at 200°F. was demonstrated by means of ASTM Standard Test Method D892-72, Sequence II.

EXAMPLES 1–10

Laboratory Evaluation of Foam-Preventing Agents

The tests were carried out by placing a 180 ml sample of oil containing the indicated additive with an air inlet tube and diffuser stone. After heating to 200°F. by means of a heated oil bath, air was passed through the oil for 5 minutes at 94 ml/min to induce foaming. The volume of foam produced is then measured. The oil employed for the test was used oil, obtained from differentials and manual transmissions of automobiles experiencing a foaming problem. Each was first evaluated separately in the foaming test without additive present to establish as a reference point the initial foaming characteristics.

Table I

| Example | Oil No. | Laboratory Foam-Tests at 200°F. Foaming, ml Initial | Standing | Additive Compound[1] | %by wt. | Foaming ml |
|---|---|---|---|---|---|---|
| 1 | Differential Oil C. | 760 | 280 | $Na_2SO_4$ | 0.2 | 0 |
| 2 | Differential Oil C. | 760 | 280 | $CaCl_2$ | 0.2 | 0 |
| 3 | Differential Oil D. | 940 | 650 | $Na_2SO_4$ +Oleic Acid | 0.2 0.2 | 0 |
| 4 | Differential Oil C. | 760 | 280 | CaO | 0.8 | 0 |
| 5 | Differential Oil E. | 670 | 130 | $CaSO_4$ | 0.9 | 0 |
| 6 | Differential Oil D. | 940 | 650 | CaOleate | 1.0 | 0 |
| 7 | Differential Oil D. | 940 | 650 | CaStearate | 1.0 | 0 |
| 8 | Differential Oil C. | 760 | 280 | CaStearate | 1.4 | 0 |
| 9 | Differential Oil C. | 760 | 280 | CaGlucon-ate | 1.9 | 0 |
| 10 | Differential Oil E. | 670 | 130 | CaSulfan-ilate | 2.3 | 0 |

Notes:
[1]$Na_2SO_4$, $CaCl_2$ were anhydrous laboratory reagents. CaOleate=Calcium salt of Oleic acid; CaStearate=Calcium salt of stearic acid; CaSulfanilate=Calcium salt of sulfanilic acid.

The data in Table I clearly demonstrate the effectiveness of these compounds in preventing foam. No attempt was made to pinpoint the minimum effective level for each compound, since as was said previously the initial foaming characteristics of the test oils vary greatly and therefore the minimum amounts will vary from oil to oil. In general, however, it was observed that for the organic fatty acid derivatives, amounts less than about 0.5% were relatively ineffective, whereas inorganic compounds such as sodium sulfate had marginal effectiveness at levels near 0.05%.

Field evaluations were carried out in differentials and manual gear boxes of several automobiles.

EXAMPLE 11

Field Tests with a Ford Falcon Differential.

The hypoid gear differential in a Ford Falcon was experiencing a serious foaming problem at 16,000 miles. Anhydrous sodium sulfate was added through the fill plug in an amount sufficient to give a 0.25% by weight mixture when dispersed. The Falcon was then driven 40,000 additional miles without experiencing further foaming problems. The oil was drained and full metallurgical of the gears was made. All components were found to have normal to less-than-normal wear. In 40,000 miles of driving, no foaming problems were encountered. The oil was removed and submitted to a laboratory foam test at 200°F., found: 0 foaming.

EXAMPLE 12

Field Tests under Racing Conditions

Anhydrous sodium sulfate was added to the oil of the manual transmission and differential of a GTX Holden Torana to give mixtures containing approximately 0.2% by weight sodium sulfate. The car was then raced in the Australian Bathurst 500 mile race, without experiencing foaming problems. Inspection of the gear trains after the race found the wear had been reduced by as much as 50%. In previous races, equivalent manual transmissions and differentials have experienced severe foaming problems and extreme wear when lubrication oils containing no foam-preventing additive were employed.

The results of the field tests demonstrate the effectiveness of the additives of this invention in preventing foaming in gear oils. The advantage of preventing foaming appears to be accompanied by a useful reduction in wear of the gear train parts, which suggests that lubricating effectiveness and lubricity are also enhanced by the particular additives of this invention.

The use of dehydrating compounds in lubricating oils to reduce and prevent foaming problems in transmissions and differential transmissions of automobiles under severe use conditions has thus been shown. These materials may also be expected to be quite effective in a variety of similar applications where foaming of the lubrication oil during use presents difficulties, and further applications will be apparent to one skilled in the art. While the practice of this invention has been demonstrated by the use of particular dehydrating compounds as foam preventing additives, the use of equivalent materials will be apparent to those skilled in the art, many modifications and variations may be made without departing from the spirit and scope of the invention, which is defined by the appended claims.

What we claim is:

1. A lubrication oil composition having improved resistance to foaming in use comprising a lubrication oil and a foam-preventing amount of an annydrous alkali metal or alkaline earth metal compound selected from the group consisting of oxides, sulfates and halides.

2. A method for the prevention of foaming in lubricating oils comprising the addition thereto of a foam-preventing amount of an annydrous alkali metal or alkaline earth metal compound selected from the group consisting of oxides, sulfates and halides.

3. The lubrication oil composition of claim 1 wherein the said compound is selected from the group consisting of sodium sulfate, calcium chloride, calcium oxide, calcium sulfate, and mixtures thereof.

4. The method of claim 2 wherein the said compound is selected from the group sodium sulfate, calcium chloride, calcium oxide, calcium sulfate, and mixtures thereof.

* * * * *